US011280047B2

(12) United States Patent
Morren et al.

(10) Patent No.: US 11,280,047 B2
(45) Date of Patent: Mar. 22, 2022

(54) STEEL CORD FOR ELASTOMER REINFORCEMENT

(71) Applicant: BEKAERT ADVANCED CORDS AALTER NV, Aalter (BE)

(72) Inventors: Gerd Morren, Vilvoorde (BE); Wouter Vanreyten, Tampere (FI)

(73) Assignee: BEKAERT ADVANCED CORDS AALTER NV, Aalter (BE)

( * ) Notice: Subject to any disclaimer, the term of this patent is extended or adjusted under 35 U.S.C. 154(b) by 117 days.

(21) Appl. No.: 16/648,936

(22) PCT Filed: Oct. 22, 2018

(86) PCT No.: PCT/EP2018/078853
§ 371 (c)(1),
(2) Date: Mar. 19, 2020

(87) PCT Pub. No.: WO2019/081411
PCT Pub. Date: May 2, 2019

(65) Prior Publication Data

US 2020/0248404 A1 Aug. 6, 2020

(30) Foreign Application Priority Data

Oct. 27, 2017 (EP) ..... 17198948

(51) Int. Cl.
*D07B 1/06* (2006.01)
*D07B 1/14* (2006.01)
*D07B 1/00* (2006.01)

(52) U.S. Cl.
CPC ..... *D07B 1/0613* (2013.01); *D07B 1/0626* (2013.01); *D07B 1/145* (2013.01);
(Continued)

(58) Field of Classification Search
CPC .. D07B 1/0613; D07B 1/0626; D07B 1/0633; D07B 1/145; D07B 1/24;
(Continued)

(56) References Cited

U.S. PATENT DOCUMENTS 1,481,801 A 1/1924 Harrison
2,241,955 A * 5/1941 Noyer ..... D07B 1/14 57/214

(Continued)

FOREIGN PATENT DOCUMENTS

BE 655 591 3/1965
EP 2 172 410 4/2010

(Continued)

OTHER PUBLICATIONS

International Search Report dated Jan. 14, 2019 in International (PCT) Application No. PCT/EP2018/078853.

*Primary Examiner* — Shaun R Hurley
(74) *Attorney, Agent, or Firm* — Wenderoth, Lind & Ponack, L.L.P.

(57) ABSTRACT

A steel cord for the reinforcement of elastomer products such as elevator belts, conveyor belts, synchronous or timing belts or hoses or tyres is presented. The steel cord comprises strands and monofilaments made of steel filaments. The strands themselves are also made of steel filaments twisted together. The strands form the outer layer of the steel cord. The monofilaments are twisted into the cord with the same lay length and direction as the strands and are positioned in the valleys between the strands on the radial outer side of the steel cord. The steel cord has the advantage that it has a better fill factor and a rounder aspect. Furthermore the monofilaments may act as an early wear indicator of the elastomer product.

16 Claims, 3 Drawing Sheets

(52) U.S. Cl.
CPC ..... *D07B 1/0633* (2013.01); *D07B 1/24* (2021.01); *D07B 2201/2023* (2013.01); *D07B 2201/2051* (2013.01); *D07B 2201/2055* (2013.01); *D07B 2201/2061* (2013.01); *D07B 2501/2007* (2013.01); *D07B 2501/2046* (2013.01)

(58) Field of Classification Search
CPC .... D07B 2201/2023; D07B 2201/2051; D07B 2201/2055; D07B 2201/2061
See application file for complete search history.

(56) References Cited

U.S. PATENT DOCUMENTS

| | | | | | |
|---|---|---|---|---|---|
| 2,792,868 | A * | 5/1957 | Benson | D07B 1/0613 | 152/153 |
| 3,358,435 | A | 12/1967 | Peene | | |
| 4,219,995 | A * | 9/1980 | Tajima | D07B 1/068 | 57/213 |
| 4,829,760 | A | 5/1989 | Dambre | | |
| 5,048,280 | A * | 9/1991 | Okamoto | B60C 9/005 | 57/238 |
| 6,739,433 | B1 | 5/2004 | Baranda et al. | | |
| 2004/0020578 | A1 * | 2/2004 | Sinopoli | B60C 9/0007 | 152/527 |
| 2014/0008154 | A1 * | 1/2014 | Wesson | D07B 1/14 | 187/254 |
| 2014/0260174 | A1 * | 9/2014 | Cavallin | D07B 5/007 | 57/215 |
| 2016/0167435 | A1 * | 6/2016 | Onuki | B60C 9/0007 | 152/556 |
| 2017/0328001 | A1 * | 11/2017 | Kirth | D07B 1/025 | |

FOREIGN PATENT DOCUMENTS

| | | |
|---|---|---|
| EP | 1 732 837 | 4/2011 |
| GB | 30012 | 6/1910 |
| GB | 1034328 | 6/1966 |
| JP | 2001-003283 | 1/2001 |
| JP | 2014-237908 | 12/2014 |
| WO | 2004/076327 | 9/2004 |
| WO | 2015/005482 | 1/2015 |
| WO | 2015/054820 | 4/2015 |

* cited by examiner

STEEL CORD FOR ELASTOMER REINFORCEMENT

TECHNICAL FIELD

The invention relates to a steel cord for elastomer reinforcement of elastomer products such as tires, hoses, belts such as conveyor belts, synchronous belts and elevator belts made of rubber or thermoplastic elastomers such as polyurethane based thermoplastic elastomers.

BACKGROUND ART

Within the field of elastomer reinforcement the use of steel cord is abundant. Steel cords are used to reinforce the belt and the carcass of tyres, the walls of hoses small and large and also belts such as conveyor belts, synchronous belts—also known as timing belts—flat belts, power belts and the like. In recent years the use of belts in elevators is soaring as this development allowed for the elimination of the machine room on top of the elevator shaft (U.S. Pat. No. 6,739,433).

Also there steel cords currently are the preferred way of reinforcing the belt as the steel cords can be made with high strength, high axial stiffness and low creep. Moreover, the steel cord offers sufficient fire resistance and guarantees a long lifetime. Elevator belts are produced by arranging steel cords parallel to one another in a web prior to embedding them into an elastomer jacket made of rubber or thermoplastic polyurethane. The latter material is currently most preferred as it can easily be adapted to the needs of an elevator belt in terms of friction, wear and fire resistance. Moreover, as there is no need for a vulcanisation step as for rubber, the production is energy efficient.

Elevator belts are a safety related part of an elevator and therefore need special consideration. One of the requirements is that if an elevator belt would deteriorate to the extent that further use would be unsafe this must be noticeable on the belt. Therefore quite elaborate equipment has been suggested that allows to monitor the deterioration of the steel cord in the belt. These methods are mostly based on a change in electrical resistance of the steel cords in the belt (EP 1732837, EP2172410). This change in resistance can originate from wire fractures, fretting corrosion or the deterioration of the elastomer jacket.

It is a general rule of thumb that a belt should still be able to carry at least 80% of its original breaking load when it is due for replacement. The problem is that the deterioration of a steel cord reinforced elevator belt goes very slow and this limit is in practise rarely reached. The steel cords deteriorate together gradually and it is extremely rare that due to the fracture of a single steel cord a drop in breaking load of the belt will occur. The elastomer jacket many times wears faster than the steel cords and the main reasons to exchange belts is not that the steel cords have deteriorated but that the elastomer wear is too high.

The inventors have therefore set themselves the task to develop a steel cord for the reinforcement of an elevator belt that is durable yet provides for a clear end-of-life indication without jeopardizing the safety of the elevator.

DISCLOSURE OF INVENTION

The main object of the invention is to provide a steel cord for the reinforcement of an elastomer. More specifically the steel cord is adapted to reinforce an elevator belt. The steel cord has built-in features that allow for an on time— meaning not too early and certainly not too late—detection of an eminent failure of the belt without jeopardizing the safety of the elevator. Moreover the steel cord provides for a higher strength within the same circumferential area. The method to monitor the strength of the belt is simple and efficient.

According a first aspect of the invention a steel cord is provided. The steel cord comprises strands and monofilaments made of steel. The strands themselves are made of steel filaments that are twisted together with a strand lay length and direction. The strands on their turn are twisted together with a cord lay length and direction. The strands form the outer layer of the steel cord. In a preferred embodiment the filaments have a round perpendicular cross section.

Characteristic about the steel cord is that the monofilaments are twisted with the cord lay length and direction and fill the valleys between adjacent strands on the radial outer side of the outer layer of strands of the steel cord. With 'on the radial outer side of the outer layer of strands' is meant that the centre of the monofilaments is situated radial outward of the circle formed by the centres of the strands.

The diameter of the monofilaments is larger than the gap between the adjacent strands. The gap between adjacent strands is the minimum distance between two cylinders circumscribing the strands. In a preferred embodiment the filaments have a round perpendicular cross section. The diameter of the monofilament is the average of the minimum and maximum Feret diameter as measured between parallel anvils of a micrometer perpendicular to the axis of the filament. As a result the monofilaments are contacting, are in contact, are contactable with two adjacent strands of the outer layer of the steel cord and not with e.g. the core of the steel cord if such core would be present. More specifically each monofilament is in contact or is contactable with just two neighbouring strands of the outer layer of strands of the steel cord.

The word 'monofilament' or 'monofilaments' has been chosen rather than 'filler filaments' as the latter are well-known to fill the inside interstices between filaments laid parallel to one another in parallel lay constructions also known as 'filler constructions' as such. The monofilaments in the meaning of this application do not fill the inside interstices and are visual from the outside in contradistinction with 'filler filaments' that remain hidden. The monofilaments according the invention are also larger than one would expect for filler filaments.

In an alternative and reduced embodiment the steel cord may also consist completely out of steel filaments i.e. the strands consist out of steel filaments as well as the monofilaments.

Preferably the strands are of the '1+n' type i.e. a central steel filament around which 'n' outer steel filaments are twisted. Strands of the type 1+4, or 1+5 or 1+6 are most preferred. Simple, layered type strands such as 3+6 or 3+9 can also be considered. Such strands have an inner strand of three steel filaments twisted together around which respectively six or nine outer filaments are twisted at a different lay length and/or direction. The strands can also be of the single lay type wherein all filaments are twisted together at the same lay length. Examples are $3\times(d_0|d_1|d_2)$ wherein the ratios $d_1/d_0$ is about 1.5 and $d_2/d_0$ is about 1.85 and provide a high filling degree (see for example U.S. Pat. No. 3,358,435). Alternatively the core can be of the type $3\times(d_0|2\times d_1|d_2)$ as described in U.S. Pat. No. 4,829,760 wherein $d_2/d_0$ is about 1.14 and $d_1/d_0$ is about 0.79. In this configuration the large $d_2$ filaments fill up the gap between the do filaments. In between each pair of $d_2$ filaments two smaller filaments $d_1$ are nested. '$d_i$' represents the diameter of the filaments in layer 'i' that all have the same distance to the centre of the strand.

The steel of which the steel filaments of the strands are made is plain, high carbon steel with a typical composition having a minimum carbon content of 0.40% for example above 0.65%, a manganese content ranging from 0.40% to 0.70%, a silicon content ranging from 0.15% to 0.30%, a maximum sulphur content of 0.03%, a maximum phosphorus content of 0.30%, all percentages being percentages by weight. There are only traces of copper, nickel and/or chromium. When the minimum carbon content is around 0.80 weight %, e.g. 0.775-0.825 weight % one speaks of high-tensile steel.

The steel filaments of the strands have a tensile strength of at least 2000 MPa, preferably above 2700 MPa, while strengths above 3000 MPa such as 3500 MPa are current. At present a maximum of 4200 MPa has been obtained on very fine wires. Such high strengths can be achieved by cold drawing the filaments to a sufficient degree from steel having a carbon content in excess of 0.65 wt % carbon.

The monofilaments may be made of the same kind of steel and have the same level of tensile strength as the filaments of the strands i.e. high carbon steel with a tensile strength above 2000 to about 3500 MPa.

In an alternative and equally preferred embodiment the monofilaments are made of a different kind of steel as that of the filaments of the strands. For example they may be made of low carbon steel. Low carbon steel has a composition with a carbon content ranging between 0.04 wt % and 0.20 wt %. The complete composition may be as follows: a carbon content of 0.06 wt %, a silicon content of 0.166 wt %, a chromium content of 0.042 wt %, a copper content of 0.173 wt %, a manganese content of 0.382 wt %, a molybdenum content of 0.013 wt %, a nitrogen content of 0.006 wt %, a nickel content of 0.077 wt %, a phosphorus content of 0.007 wt %, a sulfur content of 0.013 wt %.

The monofilaments may in certain embodiments have a tensile strength below 2000 MPa. By giving less cold drawing deformation and/or using steels with lower carbon contents such as for example 0.40 wt % carbon or low carbon steel, lower strengths can be obtained such as tensile strengths below 2000 MPa for example between 500 to 2000 MPa.

For certain embodiments it is preferred that the monofilaments are magnetisable i.e. are made of ferromagnetic materials. Ferromagnetic materials have a relative magnetic permeability larger than one, by preference above 50. Low carbon and high carbon steel are magnetisable materials.

The monofilaments are primarily added as 'lifetime indicators'. As they are positioned at the outside of the steel cord, they are subject to higher bending and tensile stresses compared to when they would have been placed on the inside. By now adapting the size and tensile strength of the monofilaments, the approximate time range at which the monofilaments break can be tuned. Higher diameter monofilaments will break earlier than lower diameter monofilaments due to the higher bending stresses. Alternatively or in combination lower tensile strength monofilaments—such as e.g. between 1200 and 2000 MPa—will break earlier than high tensile strength monofilaments as the yield point of lower tensile monofilaments is lower.

Moreover, as the monofilaments are situated at the outer radial side of the outer layer of strands, if they break they will pierce the polymer in which they are embedded and thereby act as a lifetime indicator. These pierced filaments can be visually detected.

Alternatively the pierced monofilaments can act as an electrical contact between the steel cord and the pulley on which the elastomer product is running. To this end an electrical tension is maintained between the pulley at one polarity (e.g. ground) and the steel cord at the other polarity. As the electrical short will only occur when the pierced monofilament touches the pulley this temporarily contact can act as a position indicator of the fracture. For example if the elastomer product is an elevator belt, the number of shorts occurring during a trip of an elevator can be counted. As soon as the total number of fractures is higher than a certain number, an indication is emitted that the elevator belt must be replaced.

In a further preferred embodiment the strand lay direction is opposite to the cord lay direction. This has the advantage that in between the strand filaments closest to the monofilaments gaps will form that allow the ingress of polymer material thereby enabling sufficient mechanical anchorage of the polymer. With the 'strand filaments closest to the monofilaments' is meant the outer filaments of the strand that touch or almost touch the monofilaments. Indeed, to the surprise of the inventors no adverse effect was observed on the mechanical anchoring of the steel cord when using an opposite lay direction between the strand and the cord.

In a further preferred embodiment the monofilaments remain within the circumscribed circle to the strands of the steel cord. The 'circumscribed circle to the strands of the steel cord' is the circle with the smallest diameter that still encircles all strands but not necessarily the monofilaments. However, it is preferred that the monofilaments remain within that circle such that the steel cord obtains an overall rounder cross section which makes it easier to process into an elastomer product.

In addition, the presence of the monofilaments increases the breaking load of the steel cord without increasing its diameter because the monofilaments increase the metallic fill factor. The metallic fill factor is the ratio of the metallic cross section of the cord divided by the area of the circumscribing circle. The metallic cross section of the steel cord is—for the purpose of this application—the sum of all individual perpendicular cross sectional areas of each filament in the steel cord.

As mentioned the diameter of the monofilaments has an influence on their fatigue life. It is therefore preferred that the monofilaments have a larger diameter than the diameter of the strand filaments closest to the filler steel filaments so that they will fail earlier than the strand filaments. Taking this further it is advantageous to the invention that the monofilaments have a diameter that is larger than the diameter of any other filament in the steel cord. The larger diameter of the monofilaments also reduces fretting of the contacted outer filaments of the strands. The diameter of the monofilament should remain lower than the diameter of the strands. If the diameter of the monofilament is about the diameter of the strand the stiffness of the steel cord becomes too high and the cord is no longer fit for its purpose. Advantageously, the diameter of the monofilament is smaller than half of the diameter of the strands, or even smaller such as for example 40%, 35 or even 30% of the diameter of the strands. Conversely, the monofilament diameter cannot be smaller than the smallest gap between the outer strands as otherwise the monofilament would be pulled into between the strands which is a highly undesirable situation.

In a further refined embodiment the diameter of the monofilament is between 1 and 20% larger, or between 5 and 20% larger or even between 5 and 15% larger than the diameter of the closest strand filament. Hence if the outer filament has diameter '$d_0$' the monofilament '$d_1$' has a diameter between $1.01 \times d_0$ and $1.20 \times d_0$ or between $1.05 \times d_0$ and $1.20 \times d_0$ or even between $1.05 \times d_0$ and $1.15 \times d_0$.

In a further preferred embodiment the monofilaments have a tensile strength that is substantially equal to the tensile strength of the strand filaments closest to the monofilaments. If the tensile strength is about equal and the diameters of the neighbouring filaments do not differ too much the fretting between the neighbouring filaments will not be excessive. With 'substantially equal' is meant that the absolute difference between the two tensile strengths is less than 200 $N/mm^2$.

In contradistinction therewith it can be advantageous to choose monofilaments that have a strength that is clearly lower than the tensile strength of the strand filaments closest to the monofilaments. In this way the monofilaments will be more susceptible to fretting and hence will indicate a fracture on time, while the outer filaments of the strands have not eroded yet.

In order to prevent that in case all monofilaments in the steel cord would break at the same spot the breaking load of the steel cord would drop below 80% of the original breaking load it is better that the contribution of all monofilaments to the breaking load of the steel cord is less than 20% of the latter. If it would be more the remaining breaking load after all monofilaments have broken at one spot would fall under 80% of the original breaking load. On the other hand it is advantageous if the contribution of the monofilaments to the total breaking load is at least 5% or even 10%.

In a further refinement of the invention, the ratio of the cross sectional area of one monofilament to the total metallic cross sectional area of all steel filaments—including the monofilaments—in the steel cord is between 2% and 5%. Alternatively worded: the cross sectional area of one of said monofilaments is between 2% and 5% of the total metallic cross sectional area of said steel cord. More preferably one monofilament accounts for at least 3% or even above 4% of the total metallic cross sectional area of the steel cord. It follows that if one monofilament breaks the metallic cross sectional area of the steel cord will diminish 2% up to 5% of the original total metallic cross sectional area.

As the cross sectional area of one monofilament is relatively large compared to the strand filaments the mass associated with the monofilament will be concomitantly large. When one of the monofilament fractures, the disturbance in a magnetic flux detector will be sufficient to be detected provided the monofilament is magnetisable. Magnetic flux detectors are known devices for detecting filament fractures in ropes or belts.

In an alternative embodiment at least one, two or more or all of the monofilaments can be coated with an electrically insulating layer. The electrically insulating layer can for example be a lacquer or extruded polymer coating. Such embodiment gives possibility for the detection of the fracture of a monofilament by electrical resistance measurement. For example the resistance of each individual monofilament can be monitored. Alternatively the resistance of all monofilaments taken in parallel can be monitored.

In an alternative embodiment at least one or two or more or all of the monofilaments are locally weakened at intervals.

With 'locally weakened' is meant that the breaking load is locally reduced over a short length for example over less than five times or less than two times the diameter of the monofilament. Such weakening can be done by mechanically deforming the wire locally for example by pinching, squeezing or flattening the wire. Alternatively the weakening can be done by locally altering the metallographic structure of the steel for example by locally heating up the wire by means of a laser pulse.

With 'at intervals' is meant that the weakening is recurring along the length of the monofilament(s). The recurrence can be irregular i.e. random but preferably it is regular or periodic. The distance between locally weakened spots can be between one tenth (0.1 times) and one hundred (100 times) of a cord lay length.

The purpose of the weakening is to have a controlled weak spot where the filler wire preferably and controllably will break.

According a further highly preferred embodiment the steel cord comprises a core around which the strands of the outer layer together with the monofilaments are twisted. According a first embodiment the core comprises or consists of synthetic or natural organic fibres that are twisted into yarns. The yarns may further be twisted into a core rope. With organic fibres are meant fibres made of carbon chemistry based polymers including pure carbon. They can be of natural origin such as cotton, flax, hemp, wool, sisal or similar materials. Alternatively the yarns can be made of carbon fibres, polypropylene, nylon, or polyester. Preferably the yarns are made of fibres of liquid crystal polymer (LCP), aramid, high molecular weight polyethylene, ultra-high molecular weight polyethylene, poly(p-phenylene-2,6-benzobisoxazole and mixtures thereof.

More preferably the core comprises or consists of steel filaments twisted together to a core strand. Possible core strands are:

- A single steel filament;
- 2, 3, 4 or 5 steel filaments twisted together to a core strand which is most preferred;
- Single layer strands such as 1+3, 1+4, 1+5, 1+6, 1+7 or 1+n representing a single steel filament around which respectively 3, 4, 5, 6, 7 or 'n' filaments are twisted. The diameters of the filament are chosen so as to have sufficient metallic filling;
- Layered type cords such 3+6, 3+9, 1+6+12, 3+9+15, 4+10+16 wherein each successive layer comprises more filaments. The layers are twisted one on top of the other wherein each layer is at least differing in either lay length and/or lay direction;
- Single lay cords wherein all filaments are twisted with the same lay direction and lay length such as compact cords, Warrington strands, Seale strands such 3|9, 3|3|6, 1|5|5|5, 1|6|6|6 and the like.

The core diameter can be measured by means of a caliper having parallel anvils. For the purpose of this application as core diameter the maximum diameter is taken as determined over different angles across a plane perpendicular to the strand by means of a micrometer having circular platten anvils. In the same manner a strand diameter can be determined. It is a preferred embodiment that the core diameter is smaller than the strand diameter.

When limiting the number of outer strands to three, four or five the core diameter will necessarily be smaller than the outer strand diameter when one wants to obtain a steel cord that is stable during use. With 'stable during use' is meant that filaments and strands do not move excessively one against the other during use. Also when the number of strands is three, four or five, the diameter of the monofilaments is largest as the valleys formed between the strands is bigger. When for example six strands are used each of the strands comprising a steel filament around which six outer steel filaments are twisted, the diameter of the monofilaments are about equal to the outer steel filaments which is a less preferred situation.

In a further preferred embodiment of the steel cord the monofilaments have a diameter of at least 0.25 mm. Possibly all other filaments are then smaller than 0.25 mm, making the monofilaments the largest in the steel cord. The overall diameter of the steel cord is preferably less than 3 mm, or less than 2 mm or even less than 1.8 mm for example around 1.5 mm. As the depth of the valleys between the outer strands scales with the diameter of the steel cord a too large diameter will result in excessively large filler diameters leading to premature failure and extreme bending stiffness. The steel cord can therefore not be simply scaled to higher diameters without giving in on other properties. The inventors therefore limit the practical use of the invention to monofilaments with a maximum diameter of 0.50 mm or even below 0.40 mm for example below or equal to 0.35 mm. All other filaments are then preferably also below that diameter.

The inventive cord shows some advantageous features compared to the prior art cords:

- As the breaking load of the monofilaments always adds to the total breaking load, a higher breaking load can be achieved compared to the same cord without monofilaments;
- The filler wires are added as lifetime indicators and will break first. The break can be detected by visual, electrical or magnetic detection;
- Even when all monofilaments break, the breaking load of the steel cord is still guaranteed to be above 80% of the original breaking load;
- The core strand is smaller than the outer strands. As a result it will not easily wick out as is the case when the core strand is large;
- The monofilaments also stabilize the cord. With this is meant that the monofilaments will help to keep the outer strands in position;
- Quite surprisingly the outer surface of the steel cord maintains its anchoring capability to the surrounding polymer. Without being limited by this explanation, the inventors attribute this to the presence of gaps between the outer strand and the monofilaments when the strand lay direction is opposite to the core lay direction.

According a second aspect an elastomer product is claimed. The elastomer product comprises steel cords as described above.

The elastomer product is preferably a belt such as an elevator belt, a flat belt, a synchronous belt or a power belt. A further preferred use is in hoses. The use in tyres may be less preferred—but therefore not excluded in special applications—given the ability to fracture of the monofilaments.

Within the context of this application an 'elastomer' is an elastic polymer material that can either be thermosetting (requiring vulcanisation or heat treatment) or thermoplastic.

Thermosetting elastomers are typically rubber materials such as natural or synthetic rubbers. Synthetic rubbers like NBR (Acrylonitrile Butadiene), SBR (Styrene Butadiene), EPDM (Ethylene Propylene Diene Monomer) or CR (Polychloroprene) or silicone rubbers are favoured. Of course different additives can be added to the polymer to adapt its properties.

Thermoplastic elastomeric materials can be e.g. thermoplastic polyurethanes, thermoplastic polyamides, polyolefin blends, thermoplastic co-polyesters, thermoplastic fluoropolymers such as polyvinylidene difluoride, or even polyoxymethylene (POM). Of these thermoplastic polyurethanes derived from a poly ether polyol, poly ester polyol or from poly carbonates are most preferred. Again these thermoplastic materials can be completed with fire retardants, wear improvement fillers, friction control fillers of organic or inorganic nature.

BRIEF DESCRIPTION OF FIGURES IN THE DRAWINGS

Figure 3:
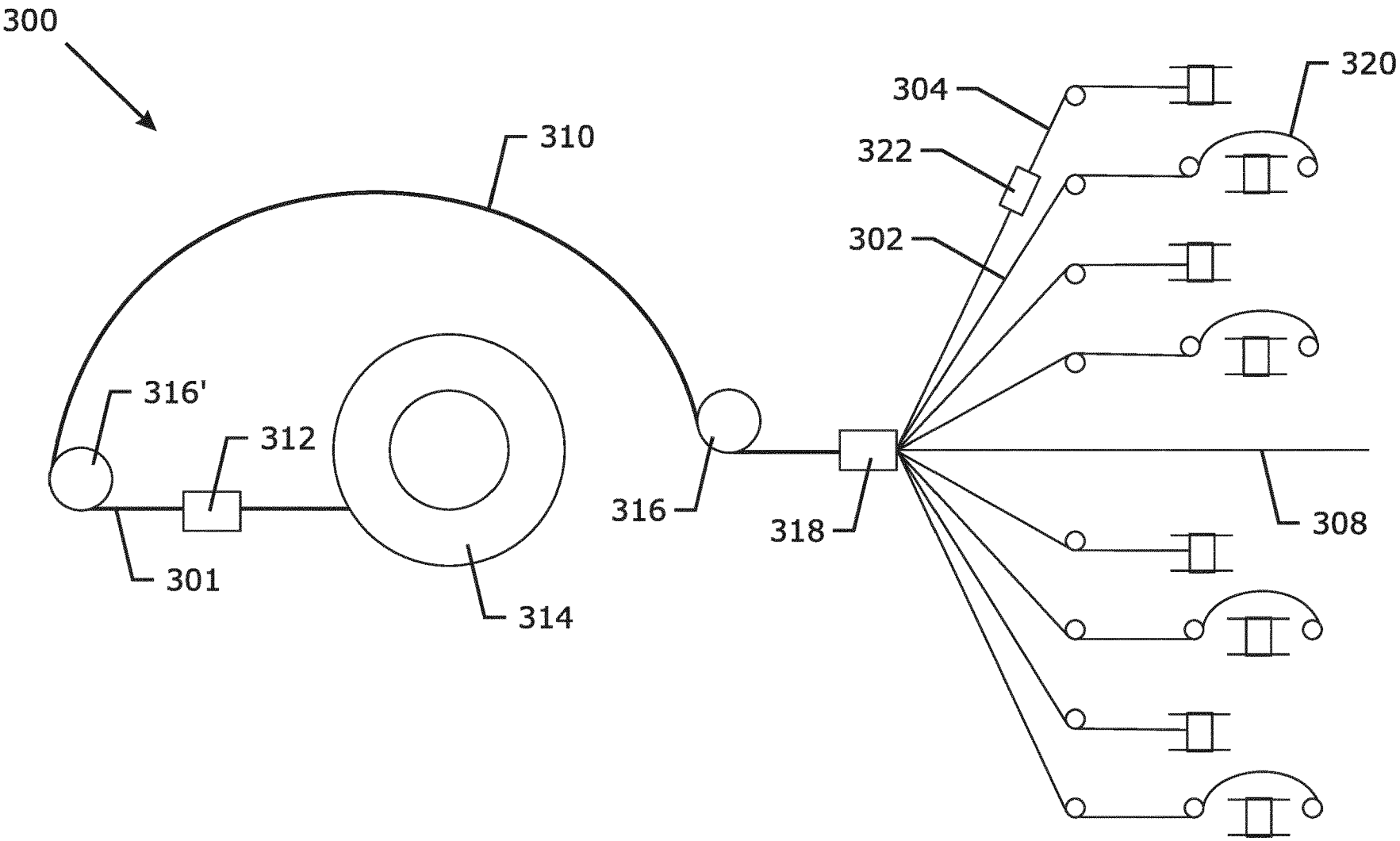
Figure 4:
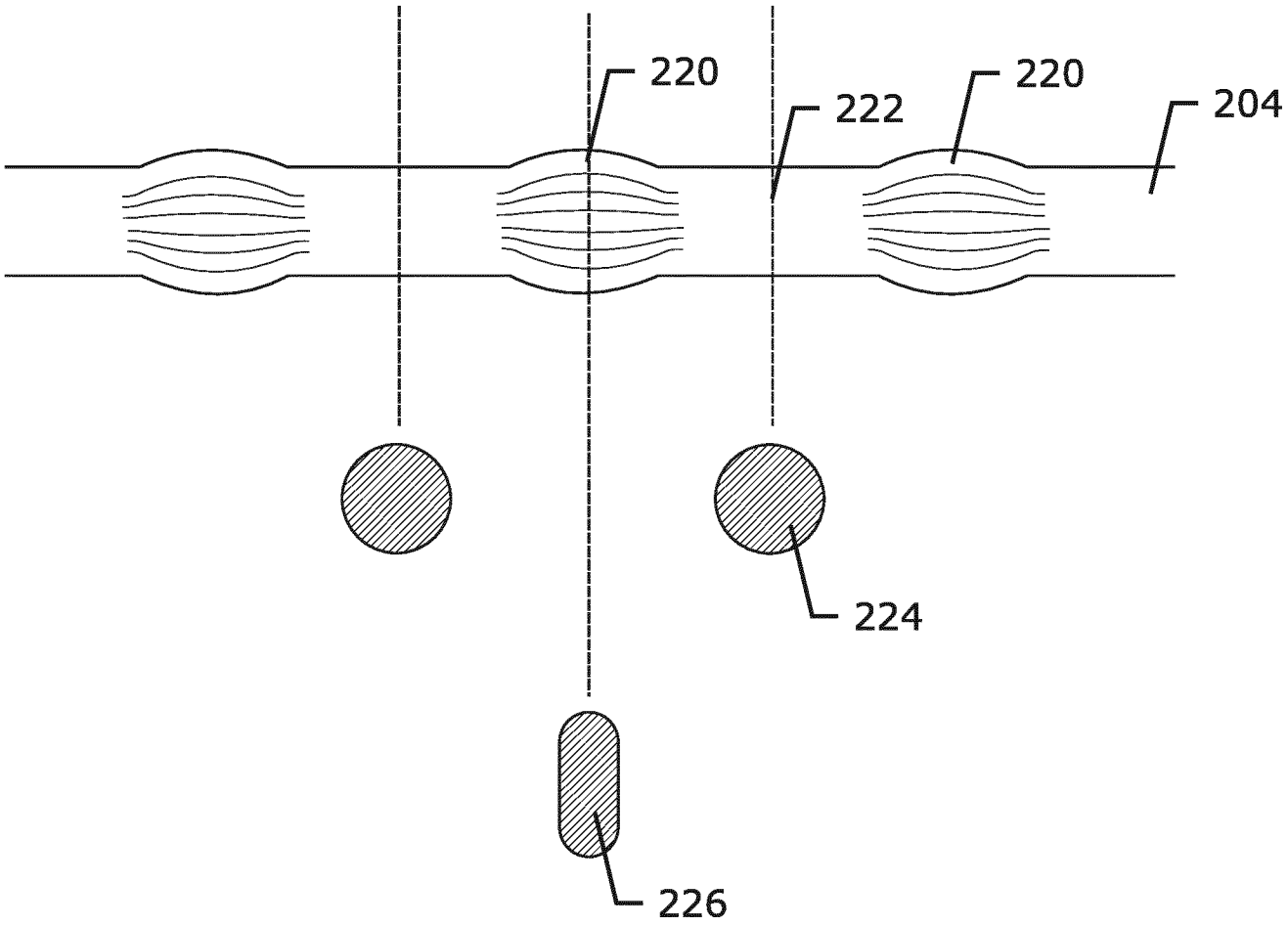

FIG. 3 describes a possible method of manufacture of the inventive steel cord;

FIG. 4 shows a monofilament having regular pinches acting as a local weakening of the filament viewed on top.

Figure 1:
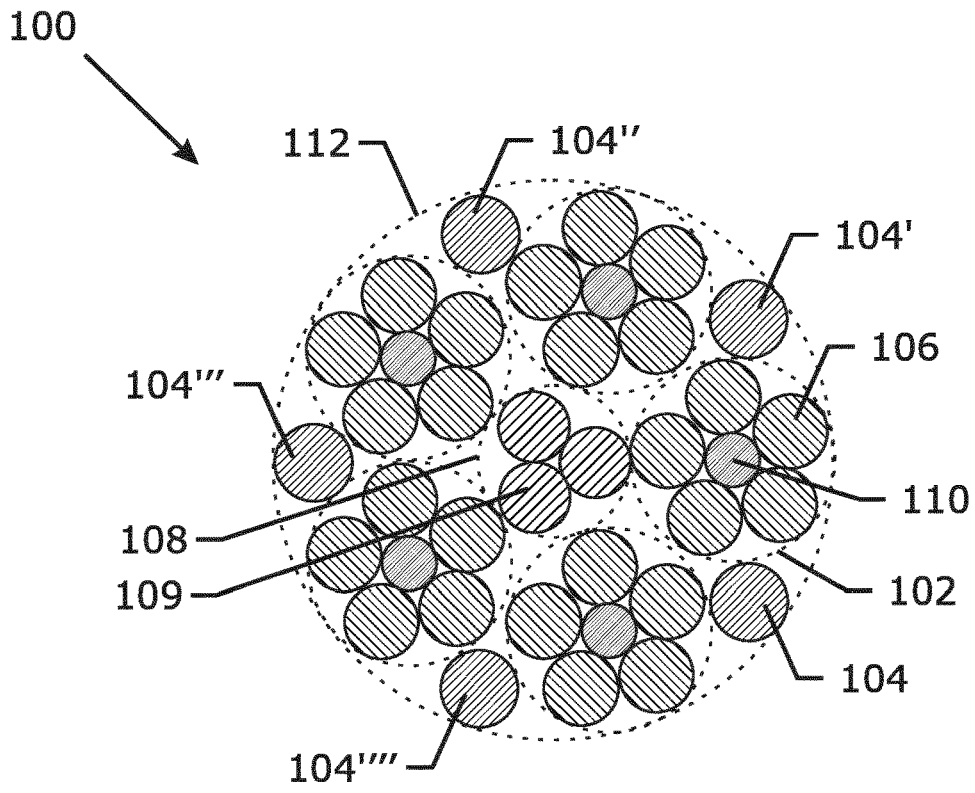
FIG. 1 is a cross section of a first preferred embodiment of the inventive steel cord.
Figure 2:
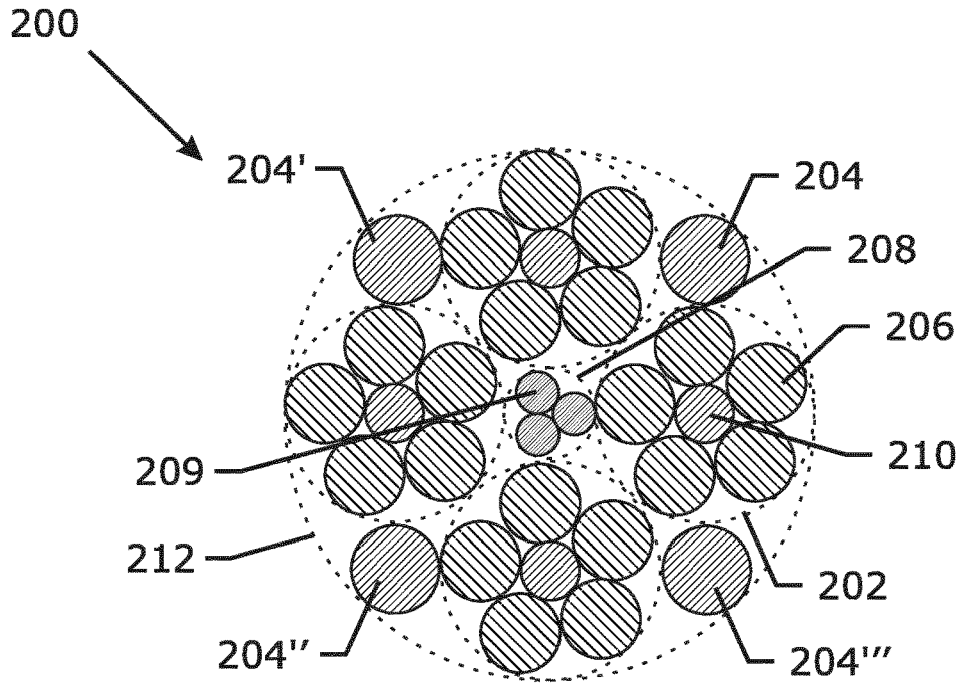
FIG. 2 is a cross section of a second preferred embodiment of the inventive steel cord.

In the FIGS. 1, 2 and 4, reference numbers having equal unit and tens numbers indicate corresponding items across figures. FIG. 3 follows its own numbering.

MODE(S) FOR CARRYING OUT THE INVENTION

According a first preferred embodiment a cord of the following construction is presented:

$$[(3\times0.22)_{10\ z}+5\times(0.17+5\times0.23)_{12\ z}|5\times0.25]_{16.3\ S}$$

In the mirror image of the steel cord every 'z' is replaced with 's' and vice versa.

The formula must be read as follows:

- The decimal numbers indicate the diameter of the filament, integers indicate the number of filaments or strands;
- The brackets contain filaments and/or strands that are laid together in one step;
- The sub-indexes indicate the lay length in mm and direction;
- A plus sign indicates that the items on both sides of the '+' are laid together have a different lay-length and/or direction;
- A stroke indicates that the items on both sides of the '|' are laid together with the same lay-length and/or direction.

A cross section of this cord 100 is represented in FIG. 1. Outer strands 102 are made of a central steel filament 110 of size 0.17 mm around which five steel filaments 106 of size 0.23 mm are twisted at lay length 12 mm in 'z' direction. The core 108 is in this case a steel filament core wherein three filaments 109 of size 0.22 mm are twisted around each other with lay length 10 mm in the 'z' direction. Around the core 108, five outer strands 102 are twisted together with five monofilaments 104, 104', 104", 104''', 104"" at lay length 16.3 in 'S' direction wherein the strands alternate with the monofilaments. The strands 102 form the outer layer of the steel cord 100. The monofilaments 104 to 104"" are nested in the valleys between the strands at the radial outer side of the outer layer.

The lay direction of the strand 'z' is opposite to the lay direction of the cord 'S'. The monofilaments 104 to 104"" all remain within the circumscribed circle 112 that is tangent to the strands 102. The monofilament 104 is closest to the outer filament of the strands 106. The diameter of the monofilament 104 is 0.25 mm and this is larger than the diameter 0.23 mm of the strand filament 106 closest to the monofilament 104. Indeed the diameter of the monofilament is 8.7% larger that of the closest outer filament. Even more: the monofilaments are the largest filaments in the steel cord.

The comparative Table 1 below shows the features of the cord when using 0.725% carbon steel and 0.825% carbon steel compared to a 0.725 wt % carbon prior-art cord ('Prior art') without monofilaments.

TABLE 1

| Property | 0.725 wt % C | 0.825 wt % C | Prior art |
|---|---|---|---|
| Tensile strength (MPa) | | | |
| 0.22 mm | 2960 | 3150 | 2960 |
| 0.17 mm | 2960 | 3150 | 2960 |
| 0.23 mm | 2880 | 3060 | 2880 |
| (*) 0.25 mm | 2750 | 2900 | — |
| Diameter (mm) | 1.73 | 1.73 | 1.73 |
| Metallic cross section ($mm^2$) | 1.51 | 1.51 | 1.27 |
| Metallic fill factor (%) | 64 | 64 | 54 |
| Mean Breaking Load (N) | 3970 | 4200 | 3340 |

The monofilament (*) of 0.25 mm shows a lower tensile strength than the closest filaments of the strand 0.23 mm for both 0.725 wt % C and 0.825 wt % C. However, the difference between the tensile strength is less than 200 MPa (130 MPa and 160 MPa respectively) so they are still very well comparable to one another. Each one of the monofilaments accounts for 3.25% of the total cross sectional area of the cord.

The contribution of the monofilaments to the breaking load can easily be assessed by the following procedure:

First the breaking load of the inventive cord is determined. The result is 'A' newton;

From the inventive cord, the monofilaments are removed. This can easily be done, as the monofilaments are at the outer side of the steel cord;

The breaking load of the remaining cord is measured: the result is '13' newton.

The contribution of the monofilaments to the total breaking load is then 100×(A−B)/A in percent. In the above case of 0.725 wt % C the contribution of the monofilaments to the breaking load is 16%. Hence, if all monofilaments would break at the same spot during use, there will still remain 84% of the original breaking load. It is to be noted that whatever the breaking load of the monofilaments is, they will always contribute to the breaking load of the steel cord.

According a second embodiment a cord of the following make is suggested of which the cross section is shown in FIG. 2:

$$[(3\times0.15)_{9\ z}+4\times(0.19+5\times0.265)_{14\ z}|4\times0.28]_{16.3\ S}$$

The mirror image has all lay directions reversed.

In this case the monofilaments of diameter 0.28 mm have been indented to locally reduce the tensile strength in order to obtain controlled fraction spots. To this end the monofilaments are lead in between two gears that run synchronized to one another. The phase between the gears is so adjusted that the teeth face one another (there is no gear meshing). The gap between the gear teeth is adjusted between 0.70 to 0.95 the diameter of the monofilament. When now the wire is led between the two gears two flats form diametrically to one another. This is depicted in FIG. 4 wherein the wire 204 shows cross sections 224 that are round in between the flats 220. At the flats—that are less than two times the diameter of the wire long—the cross section 226 is flattened. An apparatus to make such flats on a wire is illustrated in WO 2015/054820 wherein the procedure to make the flats is described in [33], [46] and FIGS. 5a and 5b. The disclosure is herewith specifically and/or entirely incorporated into this application.

The flats 220 result in a 10% lower breaking load of the monofilaments resulting in an overall decrease of the breaking load of the steel cord of 2% which is low. The flats result in controlled fracture places. If all monofilaments would be broken at the same spot, this would only result in a decreased of 14.3% in breaking load i.e. still 85.7% of the original breaking load is maintained.

As the monofilament is locally flattened the flats will maintain a gap between the monofilament and the outer strands. Such gaps are expected to improve the elastomer penetration into the core of the steel cord.

On this second embodiment adhesion tests with thermoplastic polyurethane were performed both with and without an adhesive. As an adhesive an organo functional silane was used as known from WO 2004/076327. To this end steel cords were embedded into small injection molded cylinders of length 25 mm and diameter 12.5 mm and pulled out along the axis after cooling for 24 hours.

TABLE 2

| Pull-out force (N) | Second embodiment | Prior art |
|---|---|---|
| Without adhesive | 1200 | 1250 |
| With adhesive | 2500 | 2300 |

The prior art cord is the cord of the second embodiment without monofilaments.

Much to their surprise the inventors did not find a significant difference between the inventive cord and prior art cords when no adhesive is used. As in that case the major part of the adhesion is due to mechanical anchorage, it appears that the mechanical anchorage is not affected by the relatively smoother outer surface. A further advantage is that as the outer metal surface of the inventive cord increases by the introduction of the monofilaments, the adhesion after application with an adhesive also greatly improves.

A third not shown embodiment has the formula:

$$[(3\times0.15)_{9z}+4\times(0.244+6\times0.238)_{14z}|4\times0.28]_{16.3\ S}$$

A fourth not shown embodiment can be build a follows:

$$[(0.21+6\times0.20)_{9z}+6\times(0.19+6\times0.18)_{14z}|6\times0.21]_{16.3\ S}$$

The latter example is somewhat less preferred as the diameter of the monofilament is not substantially different from the other diameters.

FIG. 3 illustrates how the cord can be made. In a bunching process 300 known per se, the core 308, strands 302 and monofilaments 304 are assembled at cabling die 318. The strands are drawn from a rotating pay-off stand 320 whereby their lay length is shortened during pay off. Because the lay direction of the cord is opposite to that of the strand, the lay length of the strand will increase during travel in the bow 310. The rotating pay-off stand exactly compensates for this. The monofilaments 304 can be statically paid off as they do not have a lay length. Device 322, described in WO 2015/05482, induces flats into the wire. While in this case only one monofilament is deformed, it is equally well possible to deform the other monofilaments. The flat sections introduce local preferred fracturing spots where the monofilaments are more likely to break. Two guiding pulleys 316 and 316' situated at either end of the bow 310 guide the steel cord 301 to the spool 314. On the path of the steel cord 301 a torsion elimination device 312 is introduced.

The invention claimed is:

1. A steel cord comprising strands and monofilaments made of steel, wherein said strands comprise strand filaments made of steel twisted together with a strand lay length and direction, wherein said strands are twisted together with a cord lay and direction, said strands forming the outer layer of said steel cord, wherein said monofilaments are twisted with the cord lay and direction and fill valleys between adjacent strands on the radial outer side of said outer layer of said steel cord, and wherein said monofilaments have a monofilament tensile strength, said monofilament strength being lower than the tensile strength of the strand filaments closest to said monofilaments.

2. The steel cord according to claim 1 wherein said monofilaments have a diameter, said diameter of said monofilaments is larger than a gap between said adjacent strands.

3. The steel cord according to claim 1 wherein said monofilaments remain within a circumscribed circle to said strands of said steel cord.

4. The steel cord according to claim 1 wherein said monofilaments have a diameter, said monofilament diameter being smaller than the diameter of said strands closest to said steel monofilaments.

5. The steel cord according to claim 4 wherein said monofilaments have a diameter, said monofilament diameter being larger than any of the diameters of the strand filaments.

6. The steel cord according to claim 1 wherein said monofilaments have a total monofilament breaking load, said total monofilament breaking load being lower than 20% of the breaking load of said steel cord.

7. The steel cord according to claim 1 wherein the cross sectional area of one of said monofilaments is between 2% and 5% of the total metallic cross sectional area of said steel cord.

8. The steel cord according to claim 1 wherein at least one of said monofilaments is coated with an electrically insulating layer.

9. The steel cord according to claim 1 wherein at least one of the monofilaments is locally weakened at intervals.

10. The steel cord according to claim 1 wherein said steel cord further comprises a core, said strands being twisted around said core.

11. The steel cord according to claim 10 wherein said core comprises synthetic or natural organic fibres.

12. The steel cord according to claim 10 wherein said core comprises steel filaments, forming a core strand.

13. The steel cord according to claim 10 wherein said core has a core diameter, said strands have a strand diameter, wherein said core diameter is smaller than said strand diameter.

14. The steel cord according to claim 13 wherein the number of outer strands is three, four or five.

15. The steel cord according to claim 1 wherein at least said monofilaments are larger than 0.25 mm.

16. An elastomer product comprising steel cords according to claim 1.

* * * * *